US009016816B2

(12) United States Patent
Terayama et al.

(10) Patent No.: US 9,016,816 B2
(45) Date of Patent: Apr. 28, 2015

(54) SYSTEM AND METHOD FOR PER DROP ELECTRICAL SIGNAL WAVEFORM MODULATION FOR INK DROP PLACEMENT IN INKJET PRINTING

(71) Applicant: Xerox Corporation, Norwalk, CT (US)

(72) Inventors: Takahiro Peter Terayama, Portland, OR (US); Douglas Dean Darling, Portland, OR (US); Russell J. Watt, Portland, OR (US); Terrance Lee Stephens, Canby, OR (US); James Dudley Padgett, Lake Oswego, OR (US); Daniel Mark Platt, Sherwood, OR (US); Brian Edward Williams, Woodburn, OR (US); Monica Louise Maestas, Tigard, OR (US); Kenneth Eugene Strohmeyer, Jr., Wilsonville, OR (US); David L. Knierim, Wilsonville, OR (US); John Milton Brookfield, Newberg, OR (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/914,261

(22) Filed: Jun. 10, 2013

(65) Prior Publication Data

US 2014/0362135 A1 Dec. 11, 2014

(51) Int. Cl.

| | |
|---|---|
| ***B41J 29/38*** | (2006.01) |
| ***B41J 2/045*** | (2006.01) |
| ***B41J 2/21*** | (2006.01) |

(52) U.S. Cl.

CPC ..... *B41J 2/04526* (2013.01); *B41J 2/04581* (2013.01); *B41J 2/04588* (2013.01); *B41J 2/2135* (2013.01)

(58) Field of Classification Search

CPC ..... B41J 2/045–2/04598
USPC ..... 347/10
See application file for complete search history.

(56) References Cited

U.S. PATENT DOCUMENTS

| | | | | |
|---|---|---|---|---|
| 4,328,504 | A * | 5/1982 | Weber et al. | 347/14 |
| 4,714,935 | A * | 12/1987 | Yamamoto et al. | 347/10 |
| 5,461,403 | A | 10/1995 | Wallace et al. | |
| 5,502,468 | A * | 3/1996 | Knierim | 347/19 |
| 6,020,905 | A | 2/2000 | Cornell et al. | |
| 6,095,630 | A * | 8/2000 | Horii et al. | 347/10 |
| 6,102,513 | A | 8/2000 | Wen | |
| 6,296,341 | B1 * | 10/2001 | Sugahara | 347/19 |
| 6,406,116 | B1 * | 6/2002 | Katakura et al. | 347/15 |
| 6,464,322 | B2 | 10/2002 | Dunand | |
| 6,547,355 | B1 * | 4/2003 | Shimada et al. | 347/12 |
| 6,793,306 | B2 | 9/2004 | Yazdy | |
| 6,987,588 | B2 * | 1/2006 | Yao et al. | 358/3.14 |
| 7,070,346 | B2 * | 7/2006 | Fujimori | 400/76 |
| 7,393,072 | B2 * | 7/2008 | Lim et al. | 347/10 |
| 7,407,246 | B2 * | 8/2008 | Vanhooydonck | 347/15 |

(Continued)

*Primary Examiner* — Jannelle M Lebron
*Assistant Examiner* — Jeremy Bishop
(74) *Attorney, Agent, or Firm* — Maginot Moore & Beck LLP

(57) ABSTRACT

A method for operating an inkjet printer includes identifying a pattern of ink drops ejected from an inkjet with reference to image data for a printed image, identifying a waveform component for an electrical signal operating the inkjet to eject an ink drop in the pattern of ink drops with reference to at least a portion of the image data, and generating the electrical signal with the identified waveform component to eject the ink drop in the pattern of ink drops at a first velocity onto a first location of an image receiving surface.

20 Claims, 6 Drawing Sheets

(56) References Cited

U.S. PATENT DOCUMENTS

| | | | | |
|---|---|---|---|---|
| 7,413,279 | B2 * | 8/2008 | Arakawa et al. | 347/19 |
| 7,556,337 | B2 | 7/2009 | Snyder | |
| 8,004,714 | B2 | 8/2011 | Metcalfe et al. | |
| 8,057,005 | B2 | 11/2011 | Watt et al. | |
| 8,136,913 | B2 | 3/2012 | Yeh et al. | |
| 8,251,476 | B2 | 8/2012 | Shin et al. | |
| 8,300,266 | B2 * | 10/2012 | Yeh et al. | 358/1.8 |
| 8,342,623 | B2 * | 1/2013 | Hong et al. | 347/10 |
| 8,414,102 | B2 * | 4/2013 | Viturro et al. | 347/19 |
| 8,529,013 | B2 * | 9/2013 | Watt et al. | 347/19 |
| 2011/0279505 | A1 | 11/2011 | Shin et al. | |

* cited by examiner

SYSTEM AND METHOD FOR PER DROP ELECTRICAL SIGNAL WAVEFORM MODULATION FOR INK DROP PLACEMENT IN INKJET PRINTING

TECHNICAL FIELD

This disclosure relates generally to printers and, more specifically, to inkjet printers that eject ink drops onto image receiving members to form printed images.

BACKGROUND

Inkjet printers operate a plurality of inkjets in each printhead to eject liquid ink onto an image receiving member. The ink can be stored in reservoirs that are located within cartridges installed in the printer. Such ink can be aqueous ink or an ink emulsion. Other inkjet printers receive ink in a solid form and then melt the solid ink to generate liquid ink for ejection onto the imaging member. In these solid ink printers, the solid ink can be in the form of pellets, ink sticks, granules, pastilles, or other shapes. The solid ink pellets or ink sticks are typically placed in an ink loader and delivered through a feed chute or channel to a melting device, which melts the solid ink. The melted ink is then collected in a reservoir and supplied to one or more printheads through a conduit or the like. Other inkjet printers use gel ink. Gel ink is provided in gelatinous form, which is heated to a predetermined temperature to alter the viscosity of the ink so the ink is suitable for ejection by a printhead. The printer supplies either aqueous liquid ink or a phase change ink in a liquid phase to printheads for ejection through inkjets onto an image receiving surface of an image receiving member, such as a print medium or an indirect imaging belt or imaging drum. Liquid inks dry and phase change inks cool into a solid state after being transferred to a print medium, such as paper or any other suitable medium for printing.

A typical inkjet printer uses one or more printheads with each printhead containing an array of individual nozzles through which drops of ink are ejected by inkjets across an open gap to an image receiving member to form an ink image. The image receiving member can be a continuous web of recording media, a series of media sheets, or the image receiving member can be a rotating surface, such as a print drum or endless belt. Images printed on a rotating surface are later transferred to recording media by mechanical force in a transfix nip formed by the rotating surface and a transfix roller. In an inkjet printhead, individual piezoelectric, or electrostatic actuators generate mechanical forces that expel ink through an aperture, usually called a nozzle, in a faceplate of the printhead. The actuators expel an ink drop in response to an electrical signal, sometimes called a firing signal. The magnitude, or voltage level, of the firing signals affects the amount of ink ejected in an ink drop. The firing signal is generated by a printhead controller with reference to image data. A print engine in an inkjet printer processes the image data to identify the inkjets in the printheads of the printer that must be operated to eject a pattern of ink drops at particular locations on the image receiving member to form an ink image corresponding to the image data. The locations where the ink drops landed are sometimes called "ink drop locations," "ink drop positions," or "pixels." Thus, an imaging operation can be viewed as the placement of ink drops on an image receiving member with reference to electronic image data.

In order for the printed images to correspond closely to the image data, both in terms of fidelity to the image objects and the colors represented by the image data, the printheads are registered with reference to the imaging surface and with the other printheads in the printer. Registration of printheads refers to a process in which the printheads are operated to eject ink in a known pattern and then the printed image of the ejected ink is analyzed to determine the relative positions of the printheads with reference to the imaging surface and with reference to the other printheads in the printer. Operating the printheads in a printer to eject ink in correspondence with image data presumes that the printheads are level with one another across a width of the image receiving member and that all of the inkjets in the printhead are operational. The presumptions regarding the positions of the printheads, however, cannot be assumed, but must be verified. Additionally, if the conditions for proper operation of the printheads cannot be verified, the analysis of the printed image should generate data that can be used either to adjust the printheads to better conform to the presumed conditions for printing or to compensate for the deviations of the printheads from the presumed conditions.

During operation, individual inkjets in the printheads eject patterns of ink drops to form printed images, including text and graphics, on the image receiving surface. An individual inkjet includes a fluid pressure chamber that holds ink prior to ejecting each ink drop and a larger ink reservoir replenishes the pressure chamber after the ejection of each ink drop. When printing patterns of multiple ink drops during a print job, the transient motion of ink may result in variations of the mass and velocity of the ink drops that are ejected from the inkjet. Since the printhead is located at a substantially fixed distance from the moving image receiving surface, the variations in the ink drop velocity also affect the locations of where the ink drops land on the image receiving surface. The variations can lead to errors in the placement of ink drops that degrade the quality of the printed image.

Because the variations in the ink drop masses and velocities vary over time based on the pattern of operation for the inkjet, traditional registration processes are not suitable for correcting the drop placement errors. In many printer embodiments, the electrical firing signals that operate inkjets in a printhead are generated in a synchronous manner based on a clock signal that is generated at a predetermined frequency. During each period of the clock signal, the inkjet either receives the electrical firing signal to eject an ink drop, or does not receive the electrical firing signal and does not eject an ink drop. One existing solution that adjusts the relative locations of ink drops from a single inkjet adjusts the time of generation for the electrical firing signals forward or backward in time by one or more cycles of the clock signal. Commonly owned U.S. Pat. No. 8,004,714 describes a process for modifying image data to adjust the timing for generation of firing signals for ink drops by one or more cycles of the clock signal to correct for ink drop placement errors for different patterns of ink drops that the inkjet ejects during operation.

While the existing solutions for drop placement adjustment correct for some drop placement errors due to variations in the velocity of the ink drops, other drop placement errors are not well suited to correction by adjusting the time of ink drop ejection. For example, in some printed ink drop patterns, changing the clock cycle during which the inkjet ejects an ink drop includes selecting a clock cycle when the inkjet is already scheduled to eject an ink drop during a print job. Thus, the existing techniques would either print only one ink drop when the image data specify that two ink drops should be printed, or the inkjet ejects two ink drops, but at least one ink drop is not ejected during the optimal clock cycle to correct the position error. Another drawback of the existing correction process is that the printer is only capable of adjusting the time for ejection of the ink drops by an integer number of cycles in the clock signal. In some instances, the position error for the printed ink drop lies within the distance that the image receiving surface moves during a full cycle of the clock signal. Thus, changing the clock cycle during which an ink drop is ejected, which is referred to as a full-pixel adjustment, cannot compensate for sub-pixel errors that are not aligned with full-pixel intervals of the image receiving surface. Consequently, improved systems and methods for the operation of inkjets to reduce drop placement errors while printing patterns of ink drops would be beneficial.

SUMMARY

In one embodiment, a method of operating an inkjet printer that reduces placement errors for printed ink drops has been developed. The method includes identifying a pattern of ink drops for ejection from an inkjet in the printer with reference to image data for a printed image, identifying a first waveform component for a first electrical signal to operate the inkjet to eject a first ink drop in the pattern of ink drops with reference to at least a portion of the image data corresponding to the pattern of printed ink drops, and generating the first electrical signal with the first identified waveform component to operate the inkjet to eject the first ink drop in the pattern of ink drops at a first velocity onto a first location of an image receiving surface.

In another embodiment, an inkjet printer that is configured to eject ink drops with reduced placement errors has been developed. The inkjet printer includes an inkjet configured to eject drops of ink in response to receiving electrical signals, an image receiving surface configured to move past the inkjet in a print zone, a memory configured to store image data corresponding to a printed image formed, at least in part, by the inkjet on the image receiving surface, and a controller operatively connected to the inkjet and the memory. The controller is configured to identify data corresponding to a first waveform component for a first electrical signal to operate the inkjet to eject a first ink drop in a pattern of printed ink drops with reference to at least a portion of the image data corresponding to the pattern of printed ink drops, and generate the first electrical signal with the first identified waveform component to operate the inkjet to eject the first ink drop in the pattern of ink drops at a first velocity onto a first location of an image receiving surface.

BRIEF DESCRIPTION OF THE DRAWINGS

The foregoing aspects and other features of a printer that is configured to waveform component adjustments of firing signals for an inkjet to correct for drop position errors when printing patterns of ink drops are described below.

DETAILED DESCRIPTION

Figure 1:
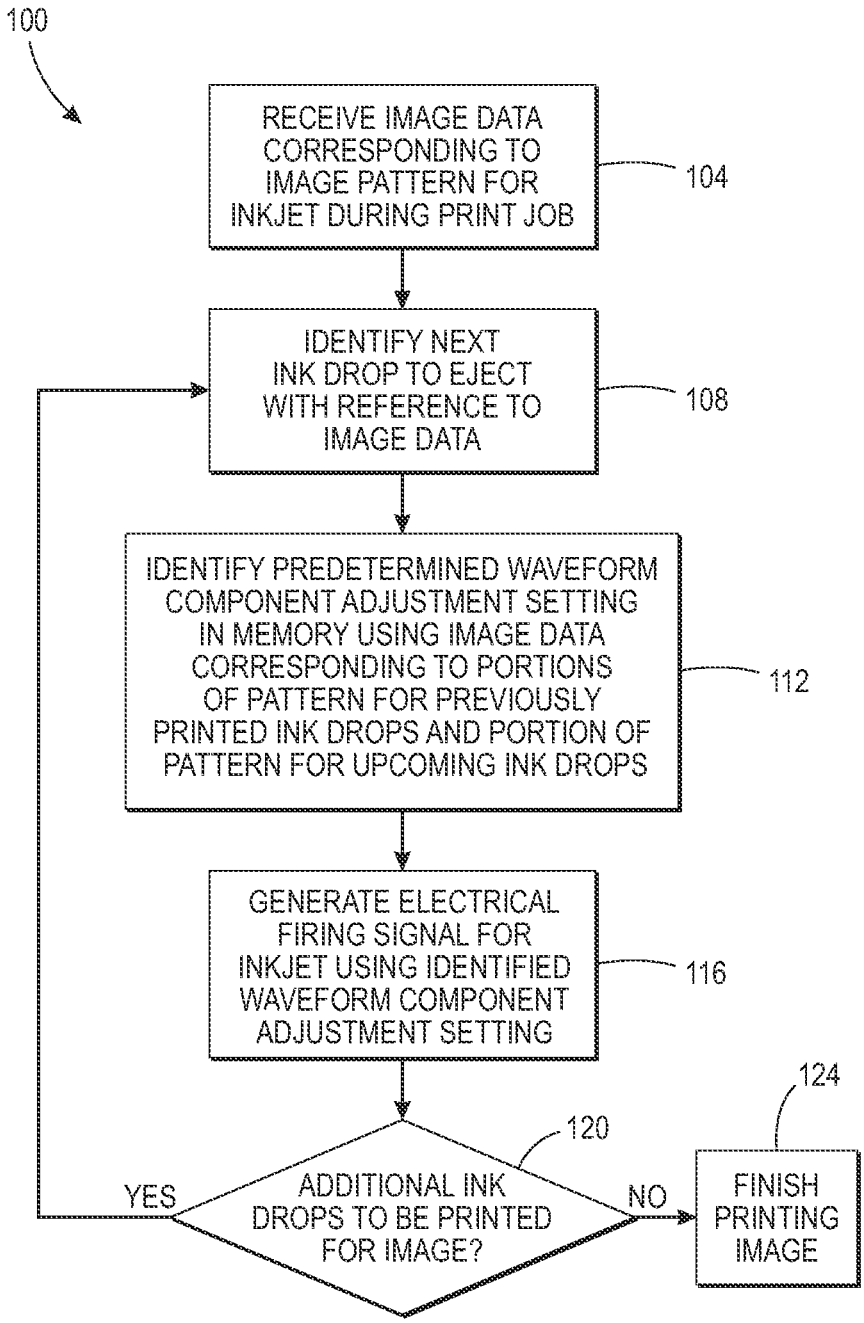
FIG. 1 is a block diagram of a process for adjusting the waveform component of firing signals that operate an inkjet on a drop-by-drop basis with reference to image data corresponding to printed patterns of ink drops during a print job.

For a general understanding of the present embodiments, reference is made to the drawings. In the drawings, like reference numerals have been used throughout to designate like elements. As used herein, the terms "printer" generally refer to an apparatus that applies an ink image to print media and can encompass any apparatus, such as a digital copier, bookmaking machine, facsimile machine, multi-function machine, etc., which performs a print outputting function for any purpose. The printer prints ink images on an image receiving member, and the term "image receiving member" as used herein refers to print media or an intermediate member, such as a drum or belt, which carries an ink image and transfers the ink image to a print medium. "Print media" can be a physical sheet of paper, plastic, or other suitable physical substrate suitable for receiving ink images, whether precut or web fed. As used in this document, "ink" refers to a colorant that is liquid when applied to an image receiving member. For example, ink can be aqueous ink, ink emulsions, melted phase change ink, or gel ink that has been heated to a temperature that enables the ink to be liquid for application or ejection onto an image receiving member and then return to a gelatinous state. A printer can include a variety of other components, such as finishers, paper feeders, and the like, and can be embodied as a copier, printer, or a multifunction machine. An image generally includes information in electronic form, which is to be rendered on print media by a marking engine and can include text, graphics, pictures, and the like.

The term "printhead" as used herein refers to a component in the printer that is configured to eject ink drops onto the image receiving member. A typical printhead includes a plurality of inkjets that are configured to eject ink drops of one or more ink colors onto the image receiving member. The inkjets are arranged in an array of one or more rows and columns. In some embodiments, the inkjets are arranged in staggered diagonal rows across a face of the printhead. Various printer embodiments include one or more printheads that form ink images on the image receiving member. Some printer embodiments include a plurality of printheads arranged in a print zone. An image receiving member, such as a print medium or an intermediate member that holds a latent ink image, moves past the printheads in a process direction through the print zone. The inkjets in the printheads eject ink drops in rows in a cross-process direction, which is perpendicular to the process direction across the image receiving member. An individual inkjet in a printhead ejects ink drops that form a line extending in the process direction as the image receiving surface moves past the printhead in the process direction.

As used herein, the terms "electrical firing signal," "firing signal," and "electrical signal" are used interchangeably to refer to an electrical energy waveform that triggers an actuator in an inkjet to eject an ink drop. Examples of actuators in inkjets include, but are not limited to, piezoelectric, and electrostatic actuators. A piezoelectric actuator includes a piezoelectric transducer that changes shape when the firing signal is applied to the transducer. The transducer proximate to a pressure chamber that holds liquid ink, and the change in shape of the transducer urges some of the ink in the pressure chamber through an outlet nozzle in the form of an ink drop that is ejected from the inkjet. In an electrostatic actuator, the ink includes electrically charged particles. The electrical firing signal generates an electrostatic charge on an actuator with the same polarity as the electrostatic charge in the ink to repel ink from the actuator, to eject an ink drop from the inkjet.

As used herein, the term "peak voltage level" refers to a maximum amplitude level of an electrical firing signal. As described in more detail below, some firing signals include a waveform with both positive and negative peak voltage levels. The positive peak voltage level and negative peak voltage level in a firing signal waveform may have the same amplitude or different amplitudes. In some inkjet embodiments, the peak voltage level of the firing signal affects the mass and velocity of the ink drop that is ejected from the inkjet in response to the firing signal. For example, higher peak voltage levels for the firing signal increase the mass and velocity of the ink drop that is ejected from the inkjet, while lower peak voltage levels decrease the mass and velocity of the ejected ink drop. Since the image receiving surface moves in a process direction relative to the inkjet at a substantially constant rate and typically remains at a fixed distance from the inkjet, changes in the velocity of the ejected ink drops affect the relative locations of where the ink drops land on the image receiving surface in the process direction.

As used herein, the term "peak voltage duration" refers to a time duration of the peak voltage level during a firing signal. The peak voltage duration can refer to the duration of both a positive peak voltage level and negative peak voltage level in a signal. Different electrical firing signal waveforms include positive peak voltage durations and negative peak voltage durations that are either equally long or of different durations. In one embodiment, an increase in the duration of the peak voltage level in the firing signal increases the ejection velocity of the ink drop while a decrease in the duration of the peak voltage level decreases the ejection velocity of the ink drop.

As used herein, the term "waveform component" refers to any parameter in the shape or magnitude of an electrical firing signal waveform that is adjusted to affect the velocity of an ink drop that is ejected from an inkjet in response to the generation of the waveform with the adjusted component parameter. The peak voltage level and peak voltage duration are examples of waveform components in electrical firing signals. As described below, an inkjet printer adjusts one or more waveform components including either or both of the peak voltage level and peak voltage duration to adjust the ejection velocities of ink drops on a drop-by-drop basis during an imaging operation. Since different ink drop ejection patterns result in variations of the ink drop velocity due to the characteristics of the inkjet and printhead, the adjustments to the waveform components enable more accurate placement of ink drop patterns on the image receiving surface during the imaging operation.

Figure 6:
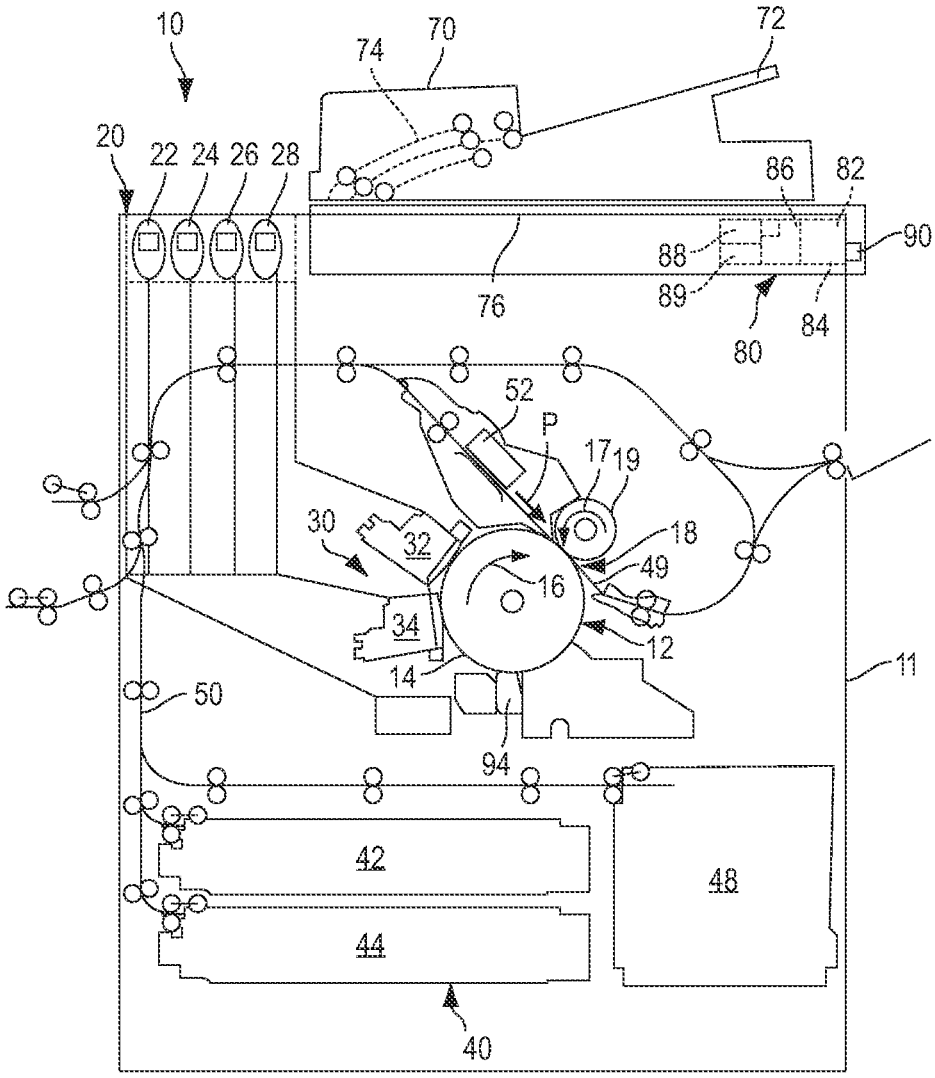
FIG. 6 is a schematic diagram of an inkjet printer that is configured to adjust the waveform component adjustment of firing signals for inkjets on a drop-by-drop basis during an imaging operation with reference to patterns of image data to reduce or eliminate drop placement errors during the imaging operation.

FIG. 6 depicts an embodiment of a printer 10 that is configured to adjust one or more waveform components of firing signals that are used to operate inkjets on a drop by drop basis during a print job. As illustrated, the printer 10 includes a frame 11 to which is mounted directly or indirectly all its operating subsystems and components, as described below. The phase change ink printer 10 includes an image receiving member 12 that is shown in the form of a rotatable imaging drum, but can equally be in the form of a supported endless belt. The imaging drum 12 has an image receiving surface 14, which provides a surface for formation of ink images. An actuator 94, such as a servo or electric motor, engages the image receiving member 12 and is configured to rotate the image receiving member in direction 16. A transfix roller 19 rotatable in the direction 17 loads against the surface 14 of drum 12 to form a transfix nip 18 within which ink images formed on the surface 14 are transfixed onto a heated print medium 49.

The phase change ink printer 10 also includes a phase change ink delivery subsystem 20 that has multiple sources of different color phase change inks in solid form. Since the phase change ink printer 10 is a multicolor printer, the ink delivery subsystem 20 includes four (4) sources 22, 24, 26, 28, representing four (4) different colors CMYK (cyan, magenta, yellow, and black) of phase change inks. The phase change ink delivery subsystem also includes a melting and control apparatus (not shown) for melting the solid form of the phase change ink into a liquid form. Each of the ink sources 22, 24, 26, and 28 includes a reservoir used to supply the melted ink to the printhead assemblies 32 and 34. In the example of FIG. 6, both of the printhead assemblies 32 and 34 receive the melted CMYK ink from the ink sources 22-28. In another embodiment, the printhead assemblies 32 and 34 are each configured to print a subset of the CMYK ink colors.

The phase change ink printer 10 includes a substrate supply and handling subsystem 40. The substrate supply and handling subsystem 40, for example, includes sheet or substrate supply sources 42, 44, 48, of which supply source 48, for example, is a high capacity paper supply or feeder for storing and supplying image receiving substrates in the form of a cut sheet print medium 49. The phase change ink printer 10 as shown also includes an original document feeder 70 that has a document holding tray 72, document sheet feeding and retrieval devices 74, and a document exposure and scanning subsystem 76. A media transport path 50 extracts print media, such as individually cut media sheets, from the substrate supply and handling system 40 and moves the print media in a process direction P. The media transport path 50 passes the print medium 49 through a substrate heater or pre-heater assembly 52, which heats the print medium 49 prior to transfixing an ink image to the print medium 49 in the transfix nip 18.

Media sources 42, 44, 48 provide image receiving substrates that pass through media transport path 50 to arrive at transfix nip 18 formed between the image receiving member 12 and transfix roller 19 in timed registration with the ink image formed on the image receiving surface 14. As the ink image and media travel through the nip, the ink image is transferred from the surface 14 and fixedly fused to the print medium 49 within the transfix nip 18. In a duplexed configuration, the media transport path 50 passes the print medium 49 through the transfix nip 18 a second time for transfixing of a second ink image to a second side of the print medium 49.

Operation and control of the various subsystems, components and functions of the printer 10 are performed with the aid of a controller or electronic subsystem (ESS) 80. The ESS or controller 80, for example, is a self-contained, dedicated mini-computer having a central processor unit (CPU) 82 with a digital memory 84, and a display or user interface (UI) 86. The ESS or controller 80, for example, includes a sensor input and control circuit 88 as well as an ink drop placement and control circuit 89. In one embodiment, the ink drop placement control circuit 89 is implemented as a field programmable gate array (FPGA). In addition, the CPU 82 reads, captures, prepares and manages the image data flow associated with print jobs received from image input sources, such as the scanning system 76, or an online or a work station connection 90. As such, the ESS or controller 80 is the main multi-tasking processor for operating and controlling all of the other printer subsystems and functions.

The controller 80 can be implemented with general or specialized programmable processors that execute programmed instructions, for example, printhead operation. The instructions and data required to perform the programmed functions are stored in the memory 84 that is associated with the processors or controllers. The processors, their memories, and interface circuitry configure the printer 10 to form ink images, and, more particularly, to control the operation of inkjets in the printhead assemblies 32 and 34 to eject ink drops to form printed images. These components are provided on a printed circuit card or provided as a circuit in an application specific integrated circuit (ASIC). Each of the circuits can be implemented with a separate processor or multiple circuits are implemented on the same processor. In alternative configurations, the circuits are implemented with discrete components or circuits provided in very large scale integration (VLSI) circuits. Also, the circuits described herein can be implemented with a combination of processors, FPGAs, ASICs, or discrete components.

In operation, the printer 10 ejects a plurality of ink drops from inkjets in the printhead assemblies 32 and 34 onto the surface 14 of the image receiving member 12. The controller 80 generates electrical firing signals to operate individual inkjets in one or both of the printhead assemblies 32 and 34. As described in more detail below, the controller 80 identifies image data that corresponding to a predetermined number of pixels that are processed before and after the generation of a firing signal to operate each inkjet in the printhead assemblies 32 and 34. The controller 80 identifies a waveform component adjustment with reference to the patterns of image data using a lookup table that is stored in the memory 84. The controller 80 adjusts the waveform components for the firing signals that are provided to each of the inkjets on a drop-by-drop basis to reduce or eliminate the drop placement errors on the image receiving surface 12 that are caused by the variations in ink drop velocity when the inkjet ejects different patterns of ink drops. While FIG. 1 depicts a controller 80 that controls the operation of the printer 10, in alternative embodiments the functionality of the controller 80 is distributed amongst one or more digital control devices in the printer. For example, in one configuration each printhead in the printhead assemblies 32 and 34 is configured with an individual printhead controller and printhead controller memory modules. The printhead controller in each printhead receives binary image data from the controller 80 and generates firing signals with varying waveform components based on predetermined waveform component data that are stored in the printhead memory modules. Any suitable configuration of one or more digital logic controllers can be used to perform the operations that are described herein.

The printer 10 is an illustrative embodiment of a printer that adjusts the waveform components of firing signals to reduce or eliminate ink drop placement errors, but the processes described herein are also applicable to alternative inkjet printer configurations. For example, while the printer 10 depicted in FIG. 6 is configured to eject drops of a phase change ink, alternative printer configurations that form ink images using different ink types including aqueous ink, solvent based ink, UV curable ink, and the like can be operated using the processes described herein. Additionally, while printer 10 is an indirect printer, printers that eject ink drops directly onto a print medium can be operated using the processes described herein.

FIG. 1 depicts a process 100 for operating an inkjet in a printer using different electrical firing signals to adjust the velocity of ejected ink drops using image data for a printed image to identify ink drops that have been previously ejected from the inkjet and ink drops that will be ejected from the inkjet during an imaging operation. In the description below, a reference to the process 100 performing or doing some function or action refers to one or more controllers or processors that are configured with programmed instructions to implement the process performing the function or action or operating one or more components to perform the function or action. Process 100 is described with reference to the printer 10 of FIG. 6 for illustrative purposes.

Process 100 begins as the printer receives image data corresponding to patterns of printed ink drops that are used to form a printed image (block 104). In the printer 10, the controller 80 receives image data in one or more digital formats. The controller 80 performs half-tone and other image operations to generate binary image data for the printheads and individual inkjets in the printhead assemblies 32 and 34. Binary image data refer to a series of data including two values (e.g. on/off, 1/0, etc.) that specify whether the controller 80 should generate a firing signal to operate the inkjet at a predetermined time, or if the inkjet should remain inactive. As described above, the printheads operate in conjunction with a synchronous clock signal at a predetermined frequency, which is typically on the order of 30-100 KHz. During each cycle of the clock signal, the controller 80 either generates a firing signal for the inkjet or does not generate a firing signal for the inkjet based on the content of the binary image data.

Figure 2:
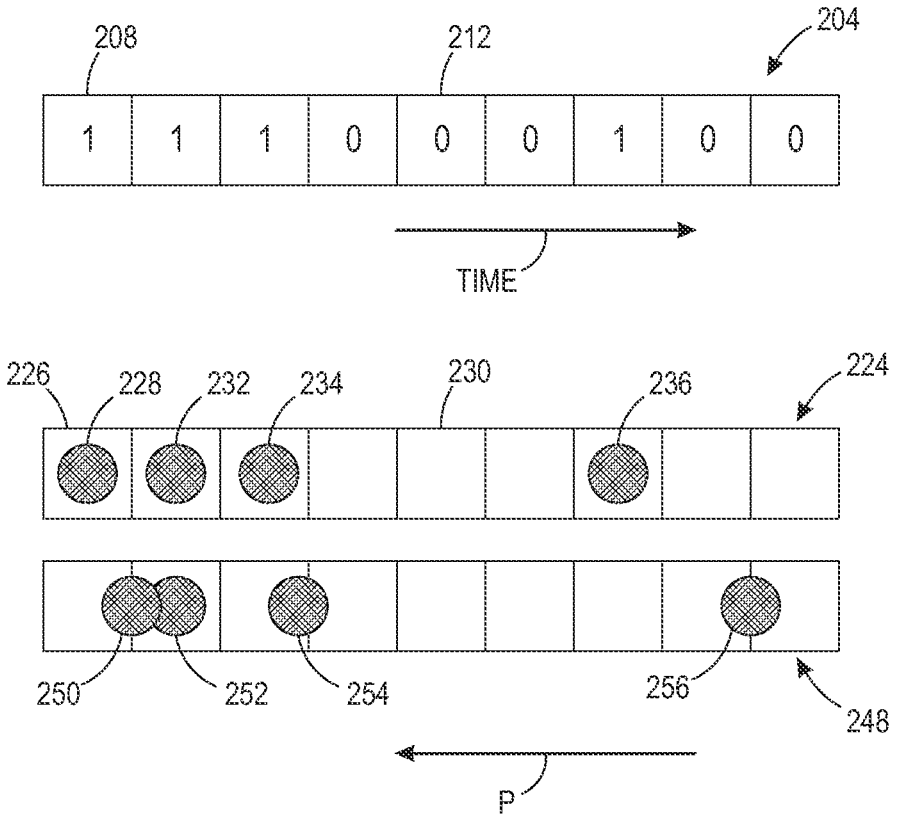
FIG. 2 is a depiction of binary image data and corresponding patterns of printed ink drops in a printed image that correspond to the binary image data.

FIG. 2 depicts an example of binary image data 204 and corresponding printed ink drops that the controller ejects from an inkjet to form a printed pattern of ink drops that correspond to the binary image data. In FIG. 2, the binary image data 204 include a plurality of pixel values that are assigned either a 1 to indicate that the inkjet should eject an ink drop for the pixel, or a 0 to indicate that the inkjet should not eject an ink drop for the pixel. For example, pixel 208 is assigned a 1 value and pixel 212 is assigned a 0 value. Each pixel of image data corresponds to a single cycle of the clock signal that is used to coordinate the operation of the inkjets in the printhead assemblies 32 and 34. Thus, in FIG. 2, the image data pixels 204 are arranged along a time axis. The arrangement of binary image data form a pattern that corresponds to the printed pattern of ink drops that are formed on the image receiving surface. In FIG. 2, the printed pattern of ink drops 224 depicts the intended locations of ink drops that are ejected based on the binary image data 204. For example, the pixel location 226 on the image receiving surface 12 of the imaging drum 14 in the printer 10 includes the ink drop 228 that is ejected based on the image data pixel 208 in the binary image data 204. The pixel location 226 is depicted as a square in FIG. 2 for illustrative purposes, but the printed image is formed from only the ink in the printed ink drops, such as the ink drop 228. In the pixel location 230, the controller does not eject an ink drop based on the 0 value of the image data pixel 212. The image receiving surface 12 moves past the inkjet in the process direction P, and the printed ink drops 224 are arranged in the pattern depicted in FIG. 2 in process direction P on the image receiving surface 12.

In FIG. 2, the printed ink drops 224 depict the intended locations of ink drops in a pattern corresponding to the image data 204. During the printing process, however, variations in the velocities of individual ink drops produce process direction position errors in the locations of the ink drops when the inkjet ejects ink using firing signals with fixed peak voltage levels and durations. The errors are repeated when particular patterns of ink drops are ejected from an inkjet. For example, in FIG. 2 the printed ink drops 248 depict ink drops 250, 252, 254, and 256 that correspond to the printed ink drops 228, 232, 234, and 236, respectively. The printed ink drops 250-256 include position errors due to variations in the velocity of the printed ink drops when the inkjet ejects the pattern of ink drops that are depicted in the image data 204. For example, the ink drop 252 is located too far in the process direction P compared to the intended location of the pixel 232. Some pixel location errors are referred to as sub-pixel errors, which correspond to a fraction of one pixel location on the image receiving surface, while other errors exceed a full pixel. For example, the printed ink drop 254 has a sub-pixel error compared to the process direction location of the pixel 234, while the pixel 256 has an error of approximately 1.5 pixels compared to the intended location of the pixel 236.

Different patterns of image data and corresponding patterns of ink drops, including sequences of repeated ejections of ink drops and sequences where the inkjet ejects ink drops intermittently, generate different variations in the velocities of printed ink drops. During process 100, the printer 10 adjusts the waveform components of individual firing signals that are generated to eject the individual ink drops to adjust the velocities of the ink drops. The adjustment of the ink drop velocity corrects for sub-pixel placement errors and corrects for some full-pixel errors if the magnitude of the full pixel error is within a predetermined range, such as up to two full pixels Larger full-pixel positional errors may be corrected more effectively through adjustment of the time of operation for the inkjet using the methods described in U.S. Pat. No. 8,004,714 in conjunction with the waveform adjustment described in this patent. Thus, process 100 enables the printer 10 to eject ink drops in the intended locations as depicted by the printed ink drops 224 to correct the individual drop placement errors that are depicted by the printed ink drops 248.

Referring again to FIG. 1, process 100 continues as the printer identifies the next ink drop that is to be printed during the printing process with reference to the image data (block 108). In the printer 10, the controller 80 maintains a memory pointer, counter, or other suitable identifier to identify the binary image data corresponding to the next cycle of the clock signal that coordinates operation of the inkjet in the printhead. If the binary image data for the next cycle of the clock signal indicates that the inkjet should not print an ink drop (e.g. a binary value of 0), then the controller 80 does not generate a firing signal for the inkjet. The controller 80 continues until the identification of binary image data corresponding to the inkjet indicating that the inkjet should eject an ink drop (e.g. a binary value of 1).

After identifying the next ink drop to be printed from the inkjet in the image data, the controller 80 identifies a predetermined waveform component adjustment settings for the firing signal that is used to eject the next ink drop. The controller 80 identifies the waveform component adjustment settings based one or both of a previous history of image data and upcoming image data for the inkjet (block 112). In the printer 10, the memory 84 includes a buffer storing a portion of the image data corresponding to the inkjet including image data from previous cycles of the clock signal for the printhead, the identified image data for the identified cycle of the clock signal when the controller generates the firing signal, and a portion of the image data from upcoming portions of the image that are printed at later times during the print job. The memory 84 also stores a lookup table data structure that associates the pattern of image data in the memory buffer with a predetermined waveform component adjustment setting that the controller 80 uses to adjust the waveform of the firing signal. As described above, in an alternative embodiment the printheads in the printhead assemblies 32 and 34 include individual memory modules that store the waveform component adjustment data in association with printhead controllers that generate the electrical firing signal waveforms using the adjusted waveform components.

Figure 3:
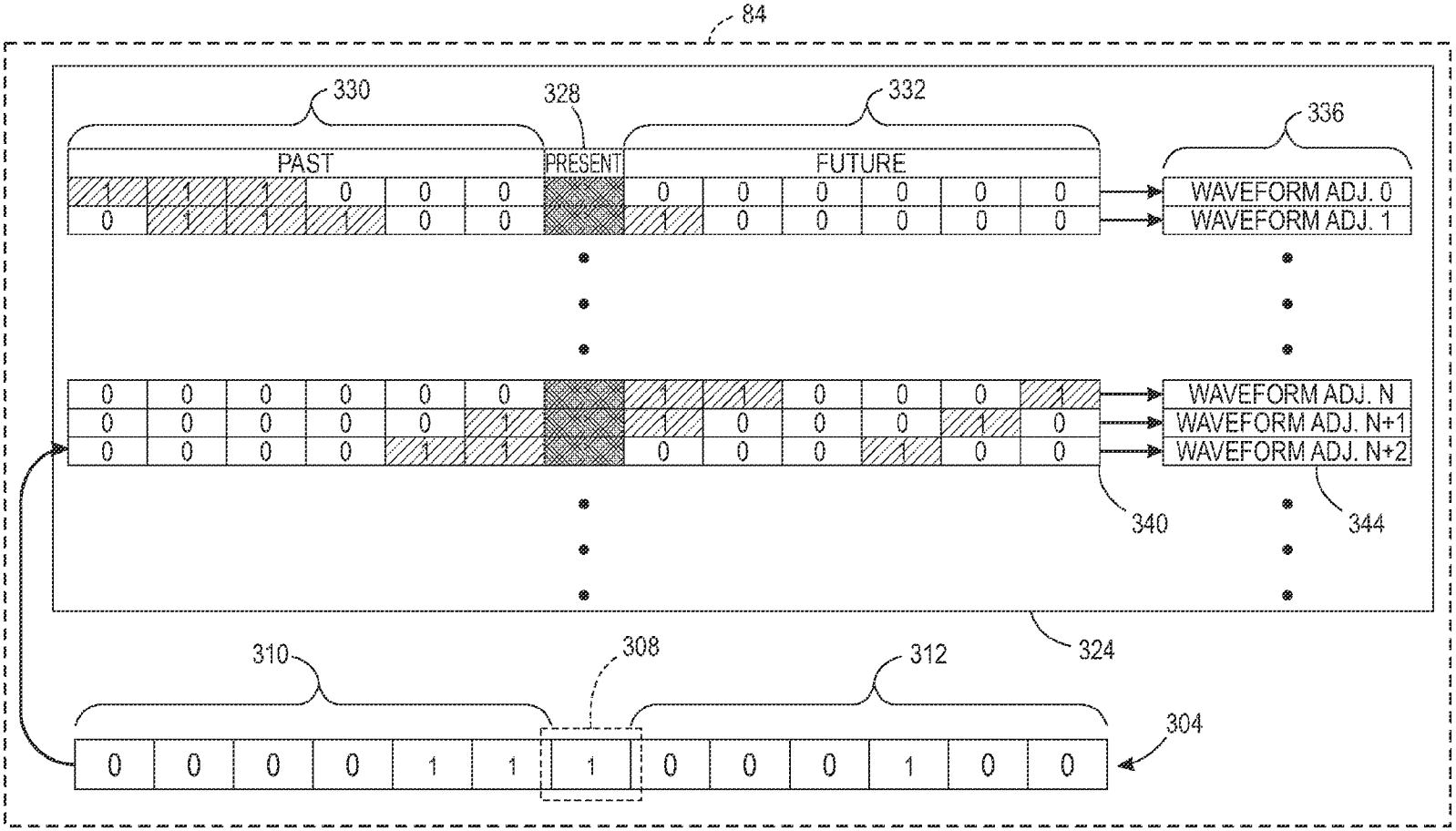
FIG. 3 is a depiction of a lookup table that is stored in a memory of a printer to identify an adjustment to a waveform component adjustment of a firing signal for an inkjet using binary image data corresponding to pixels that are processed before and after the generation of the firing signal to identify the waveform component adjustment.

FIG. 3 depicts an illustrative memory buffer 304 and lookup table 324 that are stored in the memory 84 in the printer 10 for use in identifying the waveform component adjustments used during generation of the firing signal for the next ink drop. In FIG. 3, the memory buffer 304 includes a first portion of the image data 310 that correspond to previously printed pixels in the printed image. In the example of FIG. 3, the inkjet has previously ejected ink drops corresponding to the binary pixels with a value of 1, and the inkjet does not eject ink drops for the binary pixels with a value of 0. The pixel 308 depicts the next pixel that is to be printed during the printing process. The portion of the binary image data 312 depicts upcoming or future binary image data that include any additional ink drops that will be ejected after the ejection of the ink drop for the pixel 308.

In FIG. 3, the lookup table 324 includes a plurality of lookup entries that correspond to different combinations of binary image data and corresponding predetermined waveform adjustment values. The lookup table 324 includes multiple entries that specify different patterns of binary image data including previous portions 330 of the binary image data that have already been processed during the print job, the present image data 328, and upcoming portions 332 that will be printed during future portions of the printing process. In the example of FIG. 3, the present pixel data are assumed to have a value of 1 indicating that the inkjet ejects an ink drop as part of forming the printed pattern than is specified in the binary image data. Each entry in the lookup table is associated with a waveform adjustment value 336.

In the embodiment of FIG. 3, the waveform adjustment values 336 represent a relative increase or decrease in the peak voltage level from a default peak voltage level, a relative increase or decrease in the duration of the peak voltage for the firing signal, or a combination of changes to both the peak voltage level and duration for the firing signal. The waveform adjustment values are selected for the firing signal that is used to operate the inkjet in response to identifying the corresponding pattern of image data and printed ink drops in the image. For example, the waveform adjustment value 344 can be +3 V from a default peak voltage level value for the inkjet when the controller 80 identifies that the image data correspond to the binary image data pattern in the lookup table entry 340. Another voltage adjustment entry specifies a decreased peak voltage level of, for example, −2 V. Still other waveform adjustment values increase or decrease the duration of the peak voltages in the electrical firing signals by, for example, +1 μsec or −1 μsec, respectively. In the embodiment of FIG. 3, each of the waveform adjustment entries 336 specify a single waveform component adjustment that adjusts either or both of the peak voltage level and duration of the firing signal. In an alternative embodiment the waveform component adjustments entries include either or both of a peak voltage level and duration adjustment for a positive voltage portion of the electrical firing signal waveform, and another set of adjustments for either or both of the peak voltage and duration for a negative voltage portion of the electrical firing signal waveform. In still another embodiment, the peak voltage data 336 include absolute waveform component setting values that specify either or both of the peak voltage level and duration values for the electrical firing signals instead of relative adjustment values.

The waveform adjustment values 336 in the lookup table 324 are predetermined values that are identified empirically prior to the commencement of imaging operations for the printer 10. In one embodiment, the characteristics of inkjets in the printhead are measured during the manufacture of the printhead to identify variations in the velocity of the ink drops that are ejected from the inkjet for different printed patterns of ink drops. The waveform components, which include the peak voltage levels and durations of the firing signals, are adjusted in an iterative manner to correct the variations in the ink drop velocity and corresponding identified drop placement errors that result from the variations in the velocity of ink drops for each pattern of drops. Decreasing either or both of the peak voltage level and duration of the firing signal enables ejection of the ink drop with a lower velocity, and increasing either or both of the peak voltage level and duration of the firing signal enables ejection of the ink drop with a higher velocity. The adjustment to the waveform components is made within a predetermined minimum and maximum effective peak voltage levels and durations for the printhead. If the identified error for the location of the printed ink drop is in the process direction, then the waveform adjustment is used to decrease the velocity of the ink drop to adjust the location of the printed ink drop "downstream" in the process direction. If the identified error for the location of the printed ink drops is against the process direction, then the waveform adjustment is used to increases the velocity of the ink drop to adjust the location of the printed ink drop "upstream" in the process direction.

In some configurations, the adjustment to waveform components normalize the velocities of different ink drops in the printed patterns so that the effective ejection velocity is the same for multiple ink drops in the printed pattern. The different peak voltage level and durations compensate for the variations in ejection velocity due to the physical characteristics of the inkjet and printhead while printing the pattern of ink drops. In the printer 10, the controller 80 applies up to 64 levels of voltage adjustment to the peak voltage, which enables correction of the locations of pixels with sub-pixel precision on the image receiving surface. The controller 80 similarly applies different incremental changes to the duration of the voltage peaks for the firing signal waveforms to normalize the velocity of the ejected ink drops.

In some configurations, the voltage levels are adjusted to correct the relative process direction distance between printed ink drops in a printed pattern of ink drops. Thus, the ink drops can be ejected at different velocities to position the ink drops on the image receiving surface 12 at predetermined distances in the printed pattern. To correct a positioning error where the process direction distance between two printed ink drops in a printed pattern of ink drops is too small, the waveform component adjustments increase the velocity of the first printed ink drop, decrease the velocity of the second printed ink drop, or include a combination of velocity adjustments for both ink drops to reduce the drop positioning error. Ejecting different ink drops in a printed pattern from the inkjet with different ink drop velocities also enables ejection of the ink drops without excess pressurized air and prevents the contamination of the ink with air bubbles in some embodiments. Similarly, the waveform component adjustments decrease the velocity of the first printed ink drop, increase the velocity of the second printed ink drop, or include a combination of velocity adjustments for both ink drops to reduce the drop positioning error when the distance between the process direction distance between the two ink drops is too large. In the printer 10, the memory 84 stores the lookup table 324 including the patterns of binary image data and the predetermined voltage adjustment values 336 for use in adjusting the waveform components of the firing signals during process 100.

During an imaging operation, an inkjet may remain idle for an extended time prior to being activated to eject a single ink drop or to begin ejection of a sequence of multiple ink drops. In the lookup table 304, the image data pattern for an individual ink drop includes a series of binary pixels with the value of 0 preceding the image data pixel that indicates the inkjet should eject an ink drop after a period of inactivity. In some embodiments, the waveform component adjustment for the firing signal increases either or both of the peak voltage level and peak voltage duration to eject the ink drop. The increased peak voltage level and peak voltage duration assist in clearing quiescent ink from the inkjet when the inkjet has remained idle for a prolonged time prior to ejecting the ink drop.

During process 100, the controller 80 identifies an entry in the lookup table 324 that corresponds to the image data in the image data buffer 304. In the example of FIG. 3, the image data buffer includes six bits of image data 310 prior to the current bit 308, and six bits of data 312 after the current bit 308. The lookup table 324 similarly includes entries with six bits of previously processed image data 330 and six bits of future image data 332 that will be processed as part of the imaging operation. In the example of FIG. 3, the memory buffer 304 corresponds to the lookup table entry 340, and the controller 80 identifies the waveform component adjustment value 344 that is used to generate the firing signal with one or more modified waveform components for the pixel 308 in the lookup table 324. In one embodiment, the lookup table 324 is an array stored in memory, and the controller 80 uses the memory buffer 304 as an index in the array to identify the corresponding waveform component adjustment value. In another embodiment, the lookup table 324 is implemented as a hash table, search tree, or other data structure that enables identification of waveform component adjustment values for different patterns of image data and corresponding patterns of printed ink drops.

Referring again to FIG. 1, after identifying the waveform component to use for the next electrical firing signal, the controller 80 generates the electrical firing signal using the selected waveform components to eject the ink drop through the inkjet (block 116). As described above, two types of modification to the waveform components in the electrical firing signal include increasing or decreasing the peak voltage level of the firing signal, and increasing or decreasing the duration of the peak voltage in the firing signal. Still other adjustments can include changes to both the level and duration of the peak voltage in the electrical firing signal.

Figure 4:
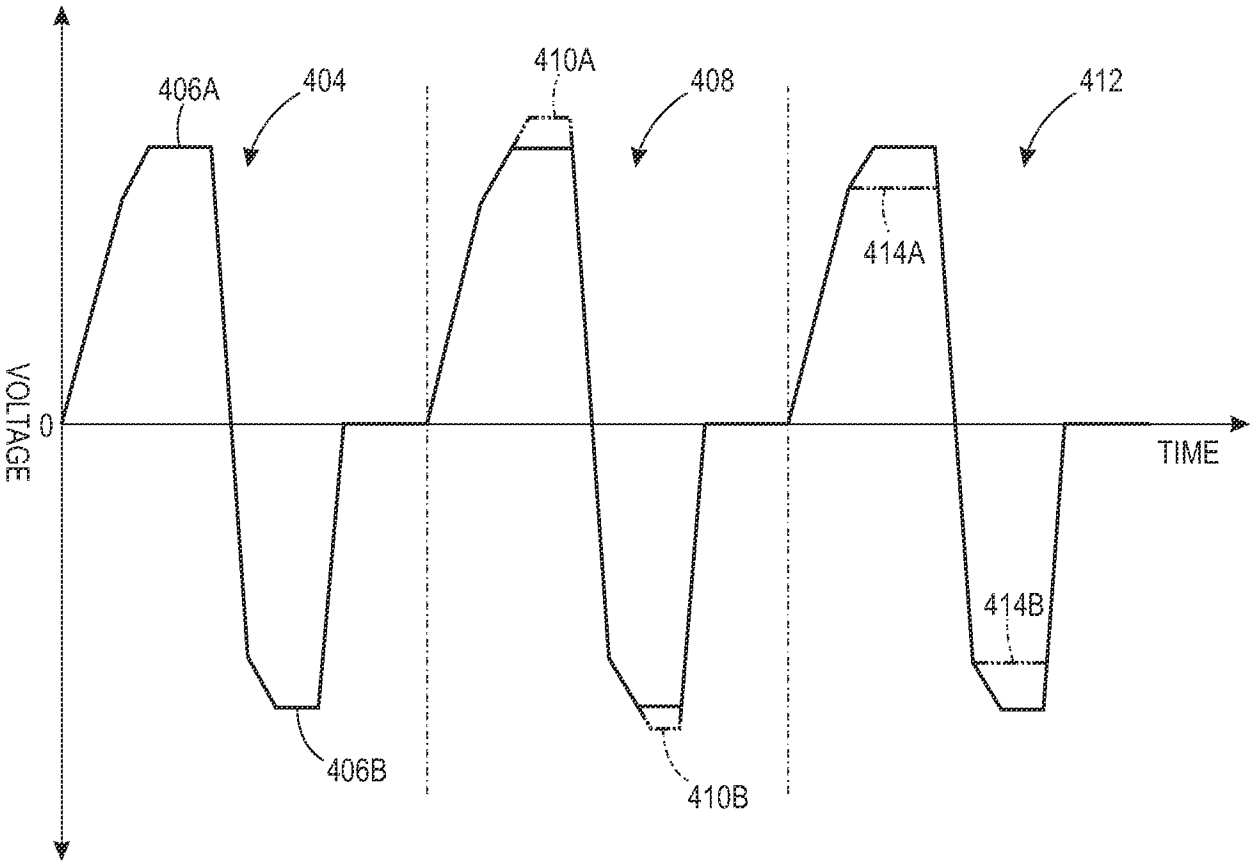
FIG. 4 is a depiction of firing signal waveforms with different peak voltage levels that are used to operate the inkjet to eject a series of ink drops during an imaging operation.

FIG. 4 depicts three illustrative firing signal waveforms 404, 408, and 412 that are generated to operate the inkjet using different peak voltage levels during process 100 and is an example of waveform adjustments N, N+1, N+2 (label accordingly) for the portion of 3-drop sequence shown in FIG. 3. The waveform 404 depicts a default peak voltage level for the inkjet with a positive peak voltage level 406A and negative peak voltage level 406B. The waveform 408 depicts an adjustment to the peak voltage level that increases the magnitude of the peak voltage level beyond the default as depicted by the positive peak voltage 410A and negative peak voltage 410B. The waveform 412 depicts an adjustment to the peak voltage level that decreases the magnitude of the peak voltage level from the default as depicted by the positive peak voltage 414A and negative peak voltage 414B. While FIG. 4 depicts the three firing signals during three consecutive cycles of the clock signal that synchronizes the operation of the printheads, the controller 80 does not generate a firing signal during cycles where the image data indicate that the inkjet should not eject an ink drop. The waveforms 404, 408, and 412 depicted in FIG. 4 are merely illustrative of different peak voltage levels for the firing signal waveform, and the printer 80 generates additional peak voltage levels between predetermined minimum and maximum peak voltage levels for the inkjet during the process 100. The controller 80 generates the default waveform or an adjusted waveform using the peak voltage level adjustment data that are retrieved from the lookup table stored in the memory 84.

Figure 5:
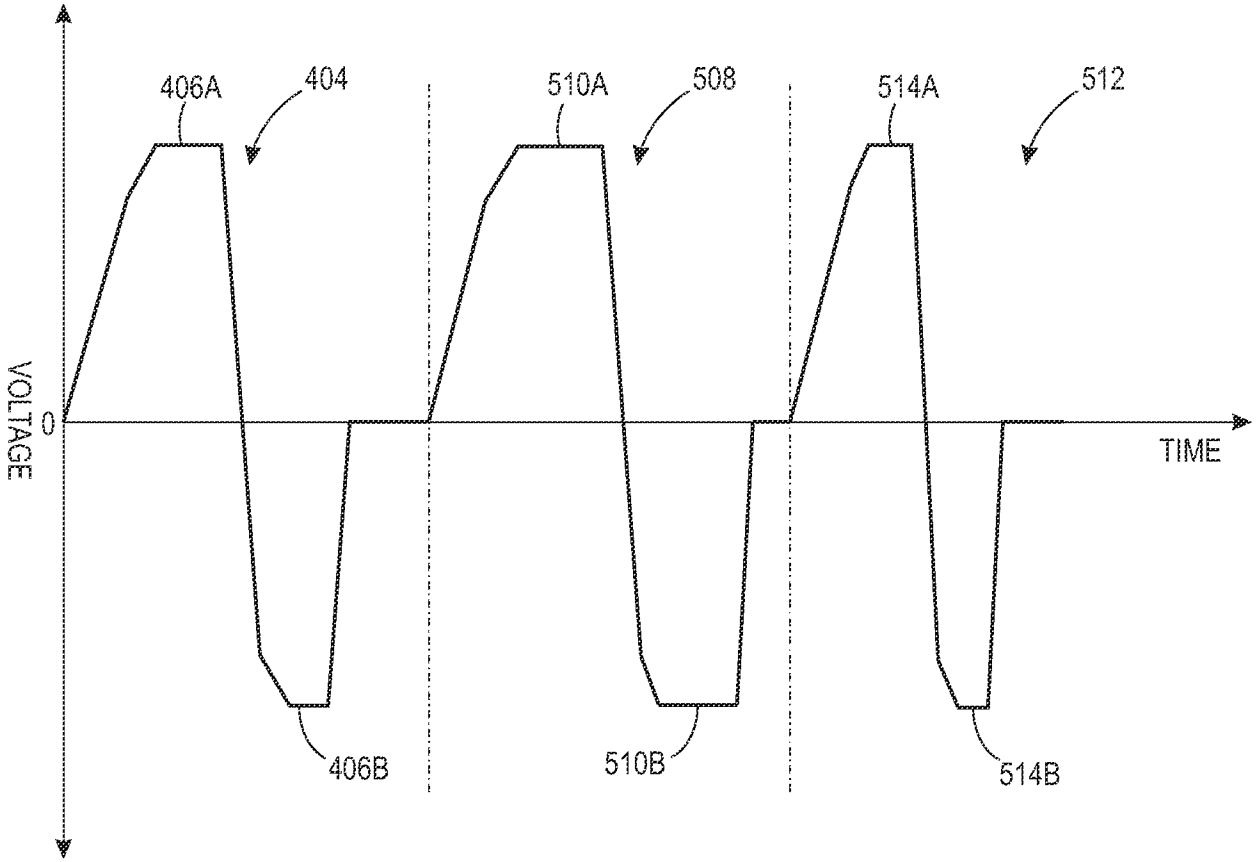
FIG. 5 is a depiction of firing signal waveforms with different peak duration times that are used to operate the inkjet to eject a series of ink drops during an imaging operation.

FIG. 5 depicts three illustrative firing signal waveforms 404, 508, and 512 that are generated to operate the inkjet during process 100 using different peak voltage durations and is an example of waveform adjustments N, N+1, N+2 (label accordingly) for the portion of 3-drop sequence shown in FIG. 3. The waveform 404 depicts the default peak voltage duration for the inkjet with a positive peak voltage level 406A and negative peak voltage level 406B, and the waveform 404 in FIG. 5 corresponds to the waveform 404 in FIG. 4 for illustrative purposes. The waveform 508 depicts an adjustment to the peak voltage duration that increases the duration of the peak voltage level beyond the default as depicted by the positive peak voltage 510A and negative peak voltage 510B. The waveform 512 depicts an adjustment to the peak voltage level that decreases the duration of the peak voltage level from the default as depicted by the positive peak voltage 514A and negative peak voltage 514B. The peak voltage durations for the firing signal are adjusted within operating parameters for the inkjet to ensure that the inkjet can eject an ink drop using the minimum peak voltage duration and that the duration of the firing signal waveforms are shorter than the duration of a single cycle of the operating clock signal in the printhead. The waveforms 404, 508, and 512 depicted in FIG. 5 are merely illustrative of different peak voltage durations for the firing signal waveform, and the printer 80 generates firing signals with different peak voltage durations between predetermined minimum and maximum peak voltage levels for the inkjet during the process 100. The controller 80 generates the default waveform or an adjusted waveform using the peak voltage duration adjustment data that are retrieved from the lookup table stored in the memory 84. In another embodiment, the controller 80 adjusts both the peak voltage level and the peak duration of the firing signal waveform using a combination of the adjustments that are depicted in FIG. 4 and FIG. 5.

Referring again to FIG. 1, the process 100 continues as the printer 10 processes additional image data for the inkjet and ejects ink drops corresponding to the image data using the waveform component adjustments that are stored in the memory 84 corresponding to the image data patterns for the inkjet (block 120). After processing the image data with no additional ink drops to be printed (block 120), the printer 10 completes process 100 for the printed ink image (block 124). While process 100 is described with reference to a single inkjet, the controller 80 adjusts the waveform component adjustments for the firing signals in each of the inkjets in the printhead assemblies 32 and 34 that are used to form the printed image. The printer 10 performs process 100 during each imaging operation for printed pages that are formed on the image receiving surface 12 and subsequently transfixed to a print medium.

It will be appreciated that variants of the above-disclosed and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. A method for operating an inkjet printer comprising:

identifying a pattern of ink drops for ejection from an inkjet in the printer with reference to image data for a printed image;

identifying a first waveform component adjustment value for a first electrical signal having a default non-zero first waveform component that operates the inkjet to eject a first ink drop in the pattern of ink drops with reference to at least a portion of the image data corresponding to the pattern of printed ink drops; and generating the first electrical signal with reference to the first identified waveform component adjustment value to change the non-zero default first waveform component for the first electrical signal to another non-zero first waveform component for the first electrical signal that operates the inkjet to eject the first ink drop in the pattern of ink drops at a first velocity onto a first location of an image receiving surface, the first velocity being a non-zero velocity that is different than a non-zero velocity corresponding to the non-zero default first waveform component.

2. The method of claim 1 wherein the first waveform component adjustment value is a change in a peak voltage level for the electrical signal.

3. The method of claim 1 wherein the first waveform component adjustment value is a change in a duration of a peak voltage level of the first electrical signal.

4. The method of claim 1 further comprising:

identifying a second waveform component adjustment value for a second electrical signal having a default non-zero second waveform component that operates the inkjet to eject a second ink drop in the pattern of ink drops with reference to at least a portion of the image data corresponding to the pattern of printed ink drops; and generating the second electrical signal with reference to the identified second waveform component adjustment value to change the non-zero default second waveform component for the second electrical signal to another non-zero second waveform component for the second electrical signal that operates the inkjet to eject the second ink drop in the pattern of ink drops at the first velocity onto a second location of the image receiving surface, the first velocity being a non-zero velocity that is different than a non-zero velocity corresponding to the non-zero default second waveform component for the second electrical signal.

5. The method of claim 1 further comprising:

identifying a first portion of the pattern of ink drops that are ejected from the inkjet prior to ejection of the first ink drop from the inkjet with reference to the image data; and identifying the first waveform component adjustment value with reference to the identified first portion of the pattern in a lookup table stored in a memory.

6. The method of claim 5 further comprising:

identifying a second portion of the pattern of ink drops that are ejected from the inkjet after ejection of the first ink drop from the inkjet with reference to the image data; and identifying the first waveform component adjustment value with reference to the identified first portion and the identified second portion of the pattern in the lookup table stored in the memory.

7. The method of claim 1 further comprising:

identifying a first portion of the pattern of ink drops that are ejected from the inkjet after ejection of the first ink drop from the inkjet with reference to the image data; and identifying the first waveform component adjustment value with reference to the identified first portion of the pattern in a lookup table stored in a memory.

8. The method of claim 1 further comprising:

identifying a second waveform component adjustment value for a second electrical signal having a non-zero default first waveform component that operates the inkjet to eject a second ink drop in the pattern of ink drops with reference to at least a portion of the image data corresponding to the pattern of printed ink drops; and generating the second electrical signal with reference to the identified second waveform component adjustment value to change a non-zero default second waveform component for the second electrical signal to another non-zero second waveform component for the second electrical signal that operates the inkjet to eject the second ink drop in the pattern of ink drops at a second non-zero velocity onto a second location of the image receiving surface, the second non-zero velocity being different than the first non-zero velocity.

9. The method of claim 8 further comprising:

generating the second electrical signal with reference to the second waveform component adjustment value to eject the second ink drop with the second non-zero velocity that is greater than the first non-zero velocity to decrease a distance between the first ink drop in the first location on the image receiving surface and the second ink drop in the second location on the image receiving surface.

10. The method of claim 8 further comprising:

generating the second electrical signal with reference to the second waveform component adjustment value to eject the second ink drop with the second non-zero velocity that is less than the first non-zero velocity to increase a distance between the first ink drop in the first location on the image receiving surface and the second ink drop in the second location on the image receiving surface.

11. An inkjet printer comprising:

an inkjet configured to eject drops of ink in response to receiving electrical signals;

an image receiving surface configured to move past the inkjet in a print zone;

a memory configured to store image data corresponding to a printed image formed, at least in part, by the inkjet on the image receiving surface; and a controller operatively connected to the inkjet and the memory, the controller being configured to:

identify a first waveform component adjustment value for a first electrical signal having a default non-zero first waveform component that operates the inkjet to eject a first ink drop in a pattern of printed ink drops with reference to at least a portion of the image data corresponding to the pattern of printed ink drops; and generate the first electrical signal with reference to the first identified waveform component adjustment value to change the non-zero default first waveform component for the first electrical signal to another non-zero first waveform component that operates the inkjet to eject the first ink drop in the pattern of ink drops at a first velocity onto a first location of an image receiving surface, the first velocity being a non-zero velocity that is different than a non-zero velocity corresponding to the non-zero default first waveform component.

12. The inkjet printer of claim 11, the controller being further configured to:

identify the first waveform component as a peak voltage level stored in the memory corresponding to the first electrical signal.

13. The inkjet printer of claim 11, the controller being further configured to:

identify the first waveform component as a peak voltage level duration stored in the memory corresponding to the first electrical signal.

14. The inkjet printer of claim 11, the controller being further configured to:

identify a second waveform component adjustment value for a second electrical signal having a default non-zero second waveform component that operates the inkjet to eject a second ink drop in the pattern of ink drops with reference to at least a portion of the image data corresponding to the pattern of printed ink drops; and generate the second electrical signal with reference to the identified second waveform component adjustment value to change the non-zero default second waveform component for the second electrical signal to another non-zero second waveform component for the second electrical signal that operates the inkjet to eject the second ink drop in the pattern of ink drops at the first velocity onto a second location of the image receiving surface, the first velocity being a non-zero velocity that is different than a non-zero velocity corresponding to the non-zero default second waveform component for the second electrical signal.

15. The inkjet printer of claim 11, the memory being further configured to:

store a lookup table including a first portion of the pattern of ink drops that are ejected from the inkjet prior to ejection of the first ink drop from the inkjet in association with data corresponding to the first waveform component; and the controller being further configured to:

identify the first portion of the pattern of ink drops that are ejected from the inkjet prior to ejection of the first ink drop from the inkjet with reference to the image data; and identify the first waveform component adjustment value with reference to the identified first portion of the pattern and the lookup table stored in the memory.

16. The inkjet printer of claim 15, the memory being further configured to:

store the lookup table including a second portion of the pattern of ink drops that are ejected from the inkjet after ejection of the first ink drop from the inkjet in association with data corresponding to the first waveform component;

identify the second portion of the pattern of ink drops that are ejected from the inkjet after ejection of the first ink drop from the inkjet with reference to the image data; and identify the first waveform component adjustment value with reference to the identified first portion of the pattern, the identified second portion of the pattern, and the lookup table stored in the memory.

17. The inkjet printer of claim 11, the memory being further configured to:

store a lookup table including a portion of the pattern of ink drops that are ejected from the inkjet after ejection of the first ink drop from the inkjet in association with the first waveform component adjustment value; and the controller being further configured to:

identify the portion of the pattern of ink drops that are ejected from the inkjet after ejection of the first ink drop from the inkjet with reference to the image data; and identify the first waveform component adjustment value with reference to the identified portion of the pattern and the lookup table stored in the memory.

18. The inkjet printer of claim 11, the controller being further configured to:

identify a second waveform component adjustment value for a second electrical signal having a default non-zero second waveform component that operates the inkjet to eject a second ink drop in the pattern of ink drops with reference to at least a portion of the image data corresponding to the pattern of printed ink drops; and generate the second electrical signal with reference to the identified second waveform component adjustment value to change a non-zero default second waveform component for the second electrical signal to another non-zero second waveform component for the second electrical signal that operates the inkjet to eject the second ink drop in the pattern of ink drops at a second non-zero velocity onto a second location of the image receiving surface, the second non-zero velocity being different than the first non-zero velocity.

19. The inkjet printer of claim 18, the controller being further configured to:

generate the second electrical signal with reference to the second waveform component adjustment value to eject the second ink drop with the second non-zero velocity that is greater than the first non-zero velocity to decrease a distance between the first ink drop in the first location on the image receiving surface and the second ink drop in the second location on the image receiving surface.

20. The inkjet printer of claim 18, the controller being further configured to:

generate the second electrical signal with reference to the second waveform component adjustment value to eject the second ink drop with the second non-zero velocity that is less than the first non-zero velocity to increase a distance between the first ink drop in the first location on the image receiving surface and the second ink drop in the second location on the image receiving surface.

* * * * *